United States Patent [19]

Sullivan et al.

[11] Patent Number: 5,007,030

[45] Date of Patent: Apr. 9, 1991

[54] TRANSDUCER ASSEMBLY FOR DEEP SUBMERGENCE

[75] Inventors: Shelby F. Sullivan, Arcadia; Harper J. Whitehouse, Haciena Heights; Richard P. Hamilton, Altadena, all of Calif.

[73] Assignee: The United States of America as represented by the Secretary of the Navy, Washington, D.C.

[21] Appl. No.: 14,824

[22] Filed: Feb. 5, 1970

[51] Int. Cl.[5] ..... H04R 1/02

[52] U.S. Cl. ..... 367/153; 367/172; 367/174; 367/176

[58] Field of Search ..... 340/8, 10, 8 MM, 8 PC, 340/8 S; 367/152, 153, 155, 156, 157, 158, 162, 163, 165, 167, 172, 173, 174, 176

[56] References Cited

U.S. PATENT DOCUMENTS 2,768,364 10/1956 Camp ..... 340/9

2,797,399 6/1957 Camp et al. ..... 340/8

*Primary Examiner*—Harold I. Tudor

*Attorney, Agent, or Firm*—Harvey Fendelman; Thomas Glenn Keough; John Stan

[57] ABSTRACT

A transducer assembly comprising: a diaphragm; at least one transducer element bonded by its head to the diaphragm; a pressure-resistant means, for supporting the transducer assembly; an acoustic isolator mounted about the transducer element and located between the diaphragm and the pressure-resistant means; the material of the acoustic isolator being elastically linear and equal in thickness to one-quarter wavelength of the corresponding operating frequency of the transducer element.

9 Claims, 5 Drawing Sheets

TRANSDUCER ASSEMBLY FOR DEEP SUBMERGENCE

BACKGROUND OF THE INVENTION

In the prior art, the method of construction of face-mounting transducer elements is to carry the deformation of the acoustic face back through the transducer elements to a stack of pressure-release paper mounted against a load-carrying plate. A pressure-release material may be briefly defined as one whose acoustic impedance, $Z=\rho c$, is less than that of water, where $\rho$=the density and c=the propagation velocity of the material. The stack might consist of as many as 96 sheets of onionskin paper. Operation depth-wise is limited, since paper is not a linear elastic material, and acoustic isolation of the transducer elements from the load-carrying plate is not complete, since the acoustic impedance of paper is not as low as it should be, and therefore the operating depth of the transducer assembly is impaired.

It is desirable to have the acoustic impedance at the back face of the heads of the transducer elements as low as possible to minimize acoustic coupling into the backing structure. This low impedance may be achieved at any frequency by designing the pressure-release material, array support structure, and the backing plate to be a resonant, acoustic transmission-line matching section. However, to maximize the transducer's bandwidth, the characteristic impedance of the pressure-release material should be as low as possible and should have small variation with changes in pressure. The pressure-release paper of the prior art is not elastically linear and therefore detunes the acoustic elements. This is so because, since the paper is elastically nonlinear, then the equivalent mechanical reactance presented to the transducer varies as a function of the amount of compression of the nonlinear material. This is analogous to a varying reactance across a resonant circuit, which detunes it.

In this invention, the pressure-release paper is replaced by a material which may be the proprietary produce called Min-K 2000, which consists essentially of silica particles in a phenolic binder, manufactured by the Johns-Manville Company, Research and Engineering Center, P. O. Box 159, Manville, N.J. 08835. In more detail, Min-K 2000 is a combination of amorphous silica and crystalline rutile, held together by asbestos fibers and phenolic resin.

A process for making a similar material is fully described in the patent having the U.S. Pat. No. 3,542,723, dated Nov. 24, 1970, entitled "Method of Molding Aggregate Pressure Release Material for Deep Submergence," and assigned to the same assignee as the subject application. Essentially, therein described a process for making a linearly elastic, pressure-release, material which retains substantially linear acoustic properties after going through a process comprising the steps of: grinding silica into finely divided particles; mixing the silica particles with a phenolic binder; forming the mixture of silica and binder into a desired structural element; and subjecting the structural element to a prestress which exceeds the operating stress at which the material is subsequently to be used.

The silica particles may be in either morphous form, such as quartz particles, or in amorphous form such as glass particles.

The material just described and the MIN-K material, either of which may be used for the purposes of this invention, will henceforth be termed by the generic term "siliceous material" or "siliceous particles."

Comparative measurements have been made on the pressure-release paper and the siliceous material; the behavior of the two materials is significantly different. While paper on initial loading behaves as a quasi-elastic material, the siliceous material behaves inelastically. However, after initial inelastic deformation, the siliceous material behaves elastically on all subsequent cycles until the maximum stress to which the material was prestressed is exceeded and beyond which the material behaves inelastically again. Thus, below the prestress limit that should be about 20% greater than the maximum stress to which the material will be subjected in use, the material behaves as an elastic material whose properties vary only slightly with depth.

The plane-wave impedance of longitudinal waves is $Z=\rho c$, where $\rho$ is the density of the material and c is the velocity of sound in the material. A comparative measurement was made of the variation of density and velocity in the paper and the siliceous material. The variation of impedance with pressure for these materials during the initial stress cycle is as follows, qualitatively. Although both materials have impedance which increases monotonically with pressure, the MIN-K starts at a lower value and increases at a lower rate. However, since the deformation of the siliceous material is inelastic during this first pressure cycle, the material's behavior is much different in subsequent cycles in which the stress is limted to smaller values than the prestress. In this case, at zero stress, the paper has the smaller initial impedance, and the initial impedance of the siliceous material is determined by the prestress. Considering the variation of the elastic behavior of the siliceous material for different prestress values, both the zero stress impedance and the slope are different for each prestress. However, for stresses greater than 2,000 psi, the impedance of the siliceous materials is always less than that of paper even when the siliceous material has been prestressed to 12,000 psi.

Since the velocity and impedance curves for siliceous material are nearly straight lines, they are completely specified by their slopes and zero stress values, which are functions of the prestress. If curves of these slopes and zero stress values are plotted, the performance of any prestressed formulation of the siliceous material may be inferred.

Since the stress in the pressure-release material is greater than the external hydrostatic pressure (by a factor given by the ratio of the area of that part of the element head exposed to the water to the are of that part of the element head backed by the siliceous material), the prestress must be much greater than the pressure of maximum operational depth. Thus, the prestress in the siliceous material at the maximum depth of 4,500 feet is 6,000 psi. In order to stabilize the siliceous material up to the 6,000 psi maximum operating stress, it is prestressed an additional 20% to 7,200 psi.

SUMMARY OF THE INVENTION

The general purpose of this invention is to provide a transducer assembly which embraces all of the advantages of similarly employed transducer assemblies and possesses none of the aforedescribed disadvantages. To attain this, the present invention contemplates a unique construction, particularly of the acoustic isolator, whose parameters are properly chosen with respect to the operating frequency of the transducer. It is also made elastically linear, so that it does not detune the acoustic transducer elements as it deforms under pressure. This combinations of characteristics and materials is believed to be new, and enables the transducer assembly to be used at much greater depths, as much as 4500 ft, than those of the prior art.

STATEMENT OF THE OBJECTS OF INVENTION

Accordingly, one object of the invention is the provision of a transducer essembly capable of being used at much greater depths than those of the prior art.

Another object is to provide a transducer which is elastically linear, and therefore does not detune the transducer element with deformation under pressure.

A further object of the invention is the provision of a transducer assembly which by its construction is isolated acoustically from the structure upon which it is mounted.

Still another object is to provide a transducer assembly wherein the acoustic isolating means may be mass-produced in segments, thereby simplifying the assembly.

BRIEF DESCRIPTION OF THE DRAWINGS

Other objects and many of the attendant advantages of this invention will be readily appreciated as the same becomes better understood by reference to the following detailed description, when considered in connection with the accompanying drawings, in which like reference numerals designate like parts throughout the figures thereof and wherein.

DESCRIPTION OF THE PREFERRED EMBODIMENTS

Figure 1:
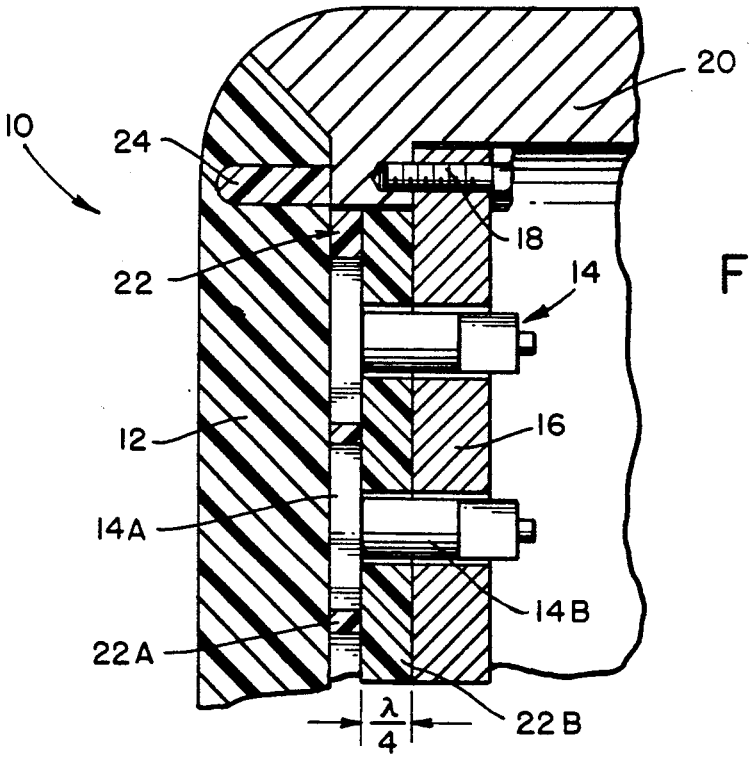
FIG. 1 is a cross-sectional view of the transducer assembly, mounted on the nose cone of a torpedo, and having a solid load-carrying or backup plate.

Referring now to the drawings, wherein like reference numerals designate like or corresponding parts throughout the several views, there is shown in FIG. 1, which illustrates a preferred embodiment, a transducer assembly 10, including a diaphragm 12 to which at least one transducer element 14 is bonded by its head 14A, for example with an epoxy adhesive. A pressure-resistant means in the form of a load-carrying backup plate 16 serves to support the transducer assembly 10. Bolts 18 attach the backup plate 16 firmly to the torpedo nose cone 20.

An acoustic isolator 22 is mounted about the head 14A of the transducer element 14, and is located between the diaphragm 12 and the backup plate 16. As shown in FIG. 1, the acoustic isolator 22 may consist of two sections, section 22A being located between the transducer heads 14A, and section 22B being located between the active parts 14B of the transducers. The acoustic isolator does not touch the active parts of the transducers. The material of the acoustic isolator 22 is elastically linear and, as shown in the figure, the more important section 22B is equal in thickness to one-quarter wavelength of the corresponding operating wavelength of the transducer element 14. This makes the reflected acoustic wave in phase with the direct signal.

A means to isolate extraneous noise from the transducer assembly 10, takes the form of an isolator, or barrier, ring 24, generally composed of the same material as the isolator 22. The ring 24 is so called because it acts as a barrier to, that is, suppresses, shell-borne noise from the torpedo.

The position of the isolator ring 24 must be considered with care, because, after all of the sounds within the torpedo have been isolated, it is very desirable that hull-borne noises be prevented from entering the transducer element 14 and, in a sense, contaminating the signal. This the isolator ring 24 does. The diameter of the isolator ring 24 is not critical. The ideal width or thickness, in the plane of the ring, for the isolator ring 24 would be a quarter of a wavelength. The signal processing system, of which the transducer 14 is a key element, will work, however very poorly, without an isolator ring 24.

A typical composition for the non-refractive and non-reflective diaphragm 12 is fully described in the copending patent application having the Ser. No. 819,056, dated 24 April 1969, entitled "Material Whose Acoustic Impedance and Index of Refraction Can Be Compositionally Controlled," and assigned to the same assignee as the subject application.

The diaphragm 12 consists of an aggregate material, described in the just mentioned patent application, which includes a base and $(N-1)$ additives, the N constituents and their fractional proportions by volume V being so chosen that the resulting aggregate material has a predetermined density $\rho$ and predetermined velocity of acoustic propagation c and, therefore, a predetermined acoustic impedance. In many practical applications, the desired predetermined density and predetermined velocity of acoustic propagation are that of ocean water.

A typical composition for the material of the diaphragm 12 would include a base material which is an epoxy resin. The other $(N-1)$ constituents may comprise plastic microspheres enclosing a liquid, for example, hexane; glass microspheres encapsulating a gas, for example air; and metal particles, such as aluminum.

The diaphragm 12 may be made by a casting process, leaving a void for the isolator or barrier ring 24, or the groove for the isolator ring may be milled out of the cast barrier ring.

The acoustic isolator 22 and isolator ring 24 are both generally made of the same material. The isolator material may be the proprietary product called Min-K 2000, described hereinabove in the section entitled "BACKGROUND OF THE INVENTION". As received from the manufacturer, this siliceous material is not suitable for direct use in hydrophone arrays. The material is characterized by inelastic deformation at static stress level significantly below those encountered in the transducer array. In order to prepare the material for use, it is subjected to a confined compression in a uniaxially loaded die to a stress level 20% greater than the maximum working stress. During this forming process the material deforms inelastically. Heat and/or pressure may be applied during the forming step.

The isolator 22 may be formed by first placing the aggregate material of which it is composed into a constraining die having the proper shape, and then precompressing the material to a pressure at which it is subsequently to be used. One alternative method for making the isolator material 22 is to precompress the aggregate material in a mold having larger dimensions than the finished product is to have. The casting is then machined to fit into place in the transducer assembly 10.

That part of the acoustic isolator 22 shown by reference numeral 22A in FIG. 1 isolates transversely. It may be of the same material as the isolator, but need not be of the same material, as is indicated in FIG. 1 by the different direction of cross-hatching.

Figure 2:
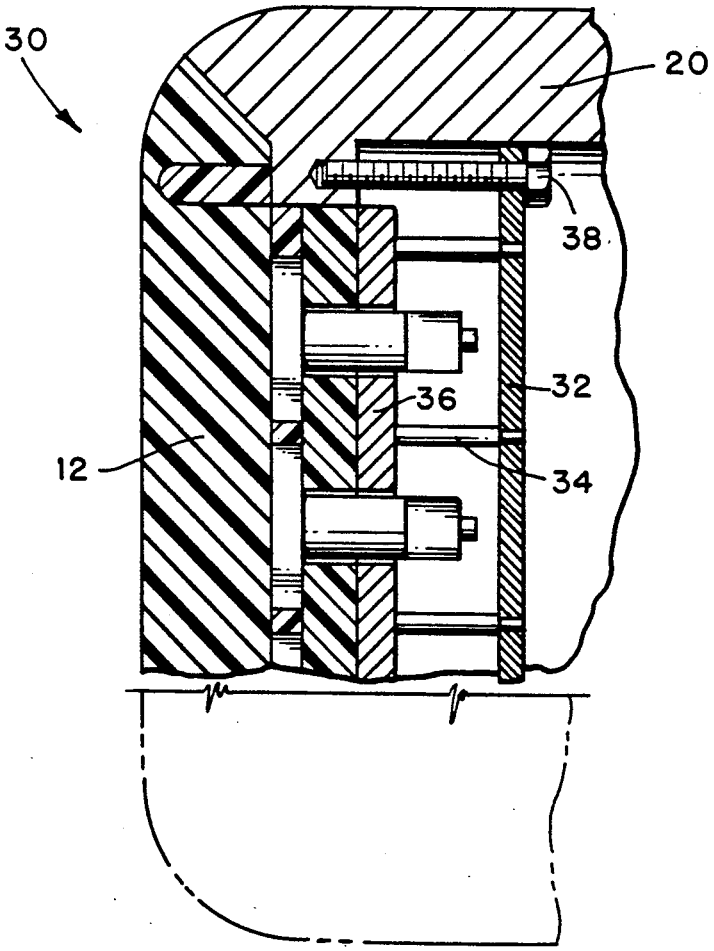
FIG. 2 is a similar cross-sectional view with the load-carrying means in a spider or framework form.

FIG. 2 shows another embodiment of a transducer assembly 30 wherein the pressure-resistant means 16 of FIG. 1, sometimes called a back-up plate, shown as a solid piece in FIG. 1, consists of a "spider" or framework having a relatively thin back-up plate 32, pins 34, which may be of fiberglass or steel, and a one-piece pressure plate 36. As was true of the embodiment shown in FIG. 1, bolts 38 sustain the diaphragm against ambient pressure, which may be considerable.

Figure 3A:
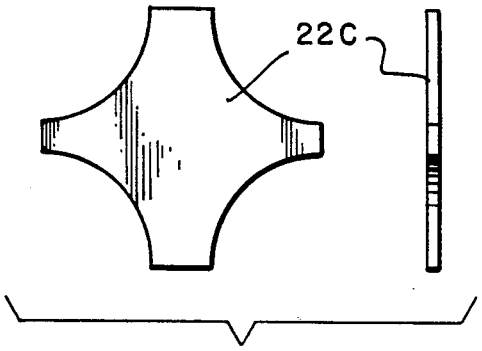
FIGS. 3A and 3B are a pair of views showing the isolator in segmental form.
Figure 3B:
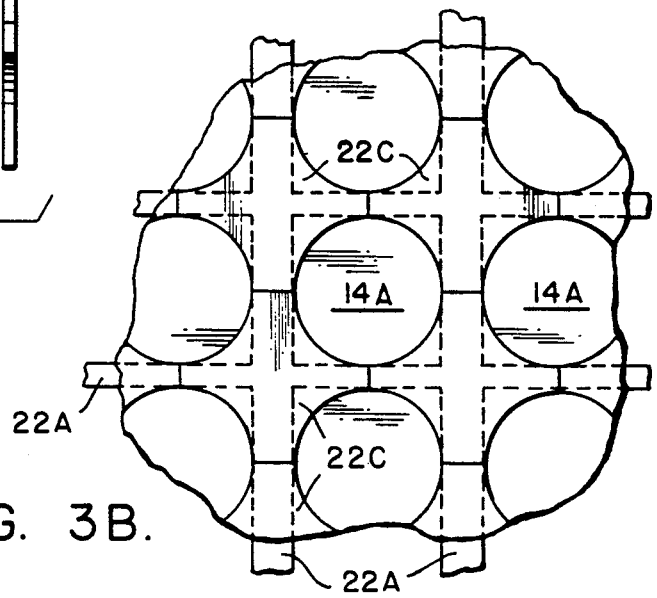

FIG. 3 shows a configuration for the isolator which consists of segments 22C which are of identical, symmetrical, form, which may be easily mass-produced, for example, by casting, and assembled. At the periphery of the transducer assembly, the segments 22C may have to be trimmed to size.

When the acoustic isolator 22 is made in segmented form, as shown in FIG. 3, the material 22A between the segments consists of powdered siliceous particles. The precast and generally prestressed segments 22C may then be pressed or laid in position.

Another manner for making the isolator 22 would be to fill the entire volume occupied by the isolator, on top of the diaphragm 12, with the powdered siliceous particles. After the transducer elements 14 are laid in place on the diaphragm 12, the siliceous material is then pressed into shape about the elements.

Figure 4A:
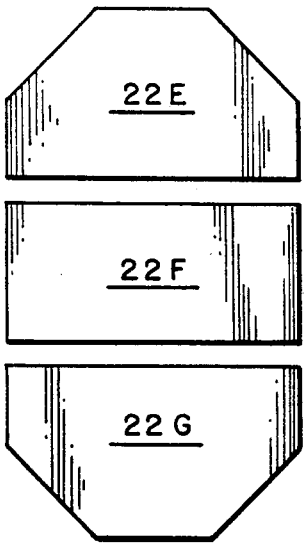
FIGS. 4A, 4B and 4C are a set of plan views showing an isolator which is made in three segments.
Figure 4B:
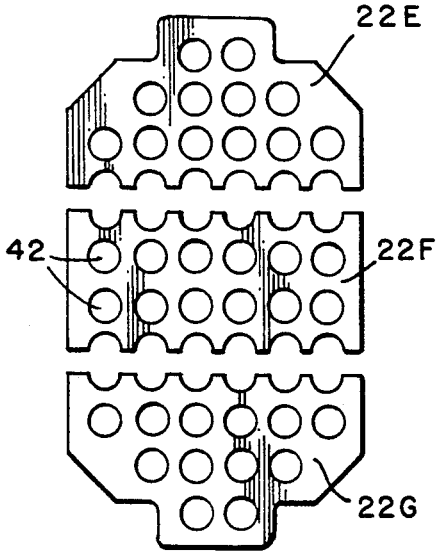
Figure 4C:
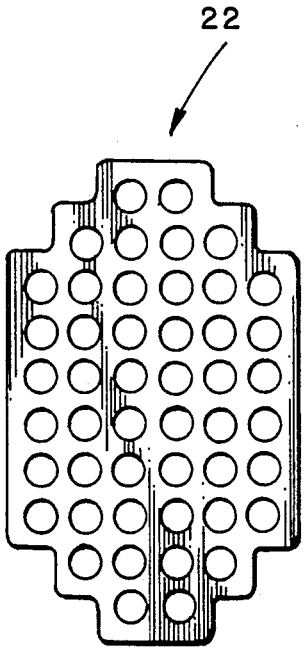

FIG. 4 shows another embodiment actually built of the isolator 22. For ease of manufacture, the isolator 22 was cast in three segments, 22E, 22F and 22G, as shown in FIG. 4A, and machined. The three segments were then pressed together and clearance holes 42 for the active parts 14B of the transducers were drilled. The material for the isolator 22 was pressed in three parts, since the total force required to prestress the siliceous material over the entire area of the disphragm 12 is quite large. Because Poisson's ratio and the tensile strength are low, the isolator material 22 must be processed carefully. During and after fabrication, care must be exercised so that the isolator 22 does not absorb unwanted contaminants such as oil and water.

Figure 5:
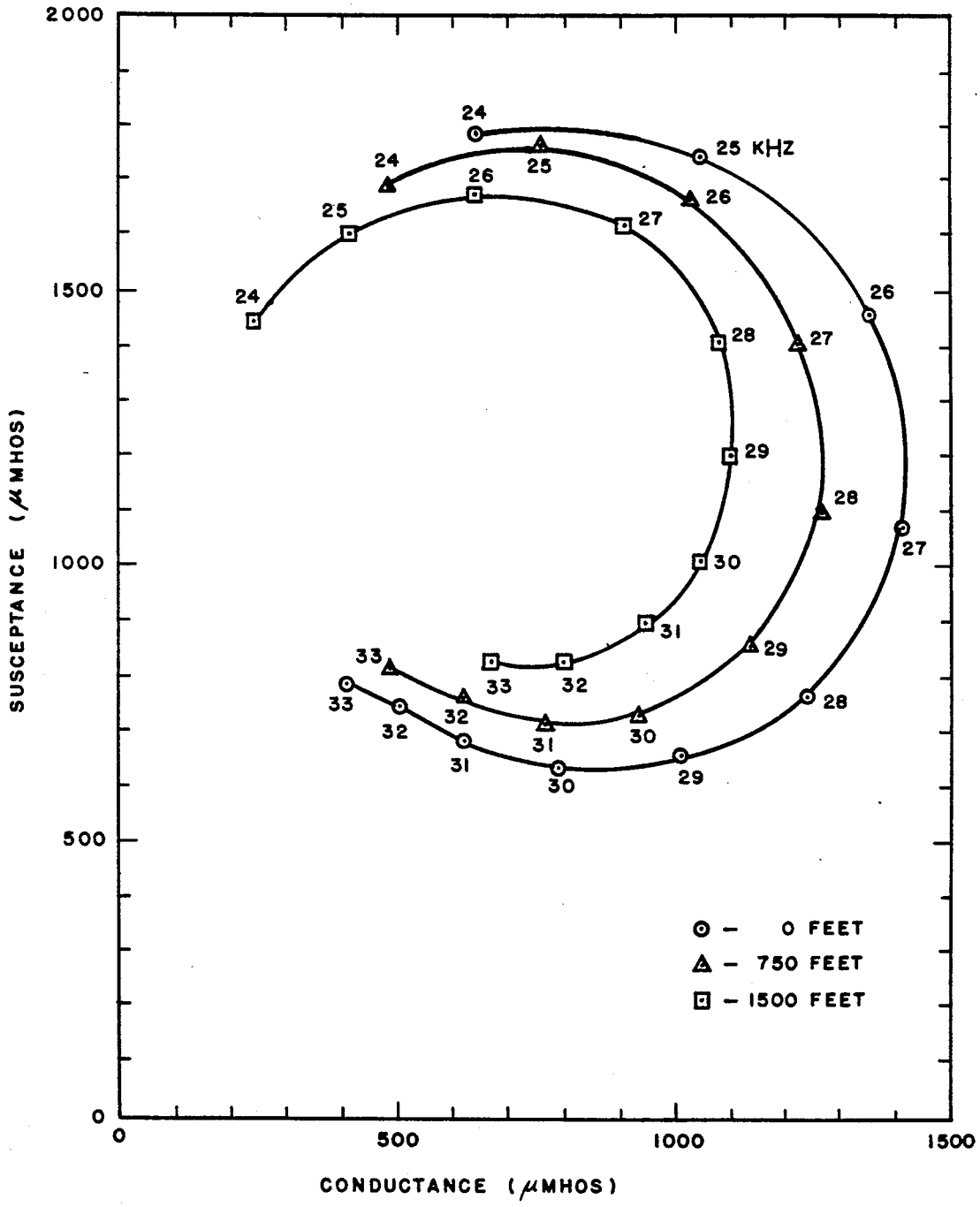
FIG. 5 is an admittance plot as a function of frequency, for the transducer assembly of the prior art, with depth as a parameter.

Reference is now directed to FIG. 5, which shows an admittance plot of the transducer configuration used in the prior art. The susceptance ordinate is plotted against the conductance abscissa, for three different values of depth, 0 ft, 750 ft, and 1500 ft, with resonant frequency of the transducer in kHz as a parameter. It will be observed that, in the prior art transducer configurations, the admittance, and therefore, the resonant frequency, is strongly dependent upon the depth of operation of the transducer. This is not desirable because, if the circuitry associated with the transducer is tuned for operation at any specific frequency for a chosen depth, the circuitry will become detuned for operation at some other depth.

Figure 6:
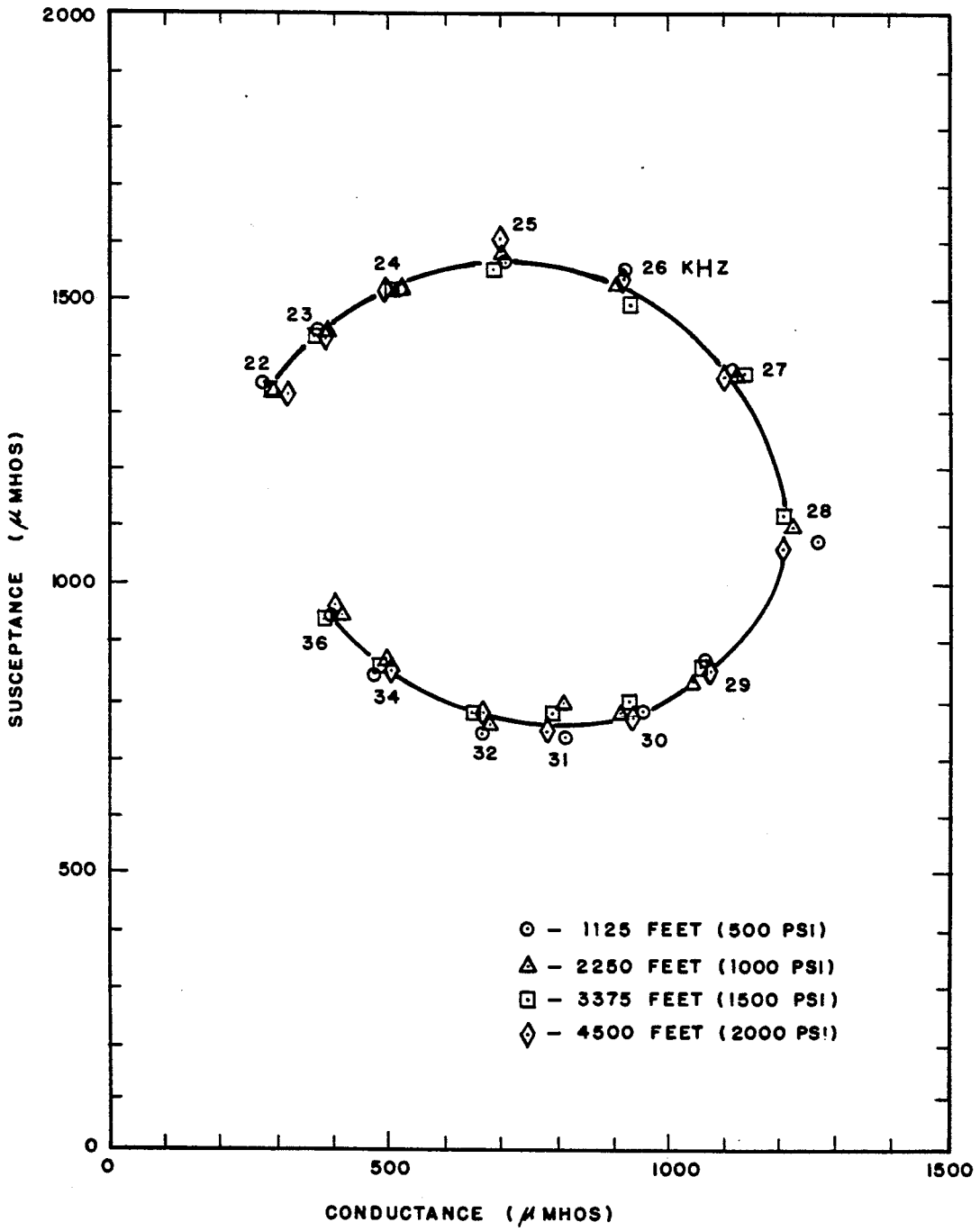
FIG. 6 is an admittance plot as a function of frequency for the transducer assembly of this invention, with depth as a parameter.

In contrast, and referring now to FIG. 6, in the transducer configurations of this invention, the susceptance, and therefore the resonant frequency, hardly varies at all with four different depths, between 1125 ft and 4500 ft.

Figure 7:
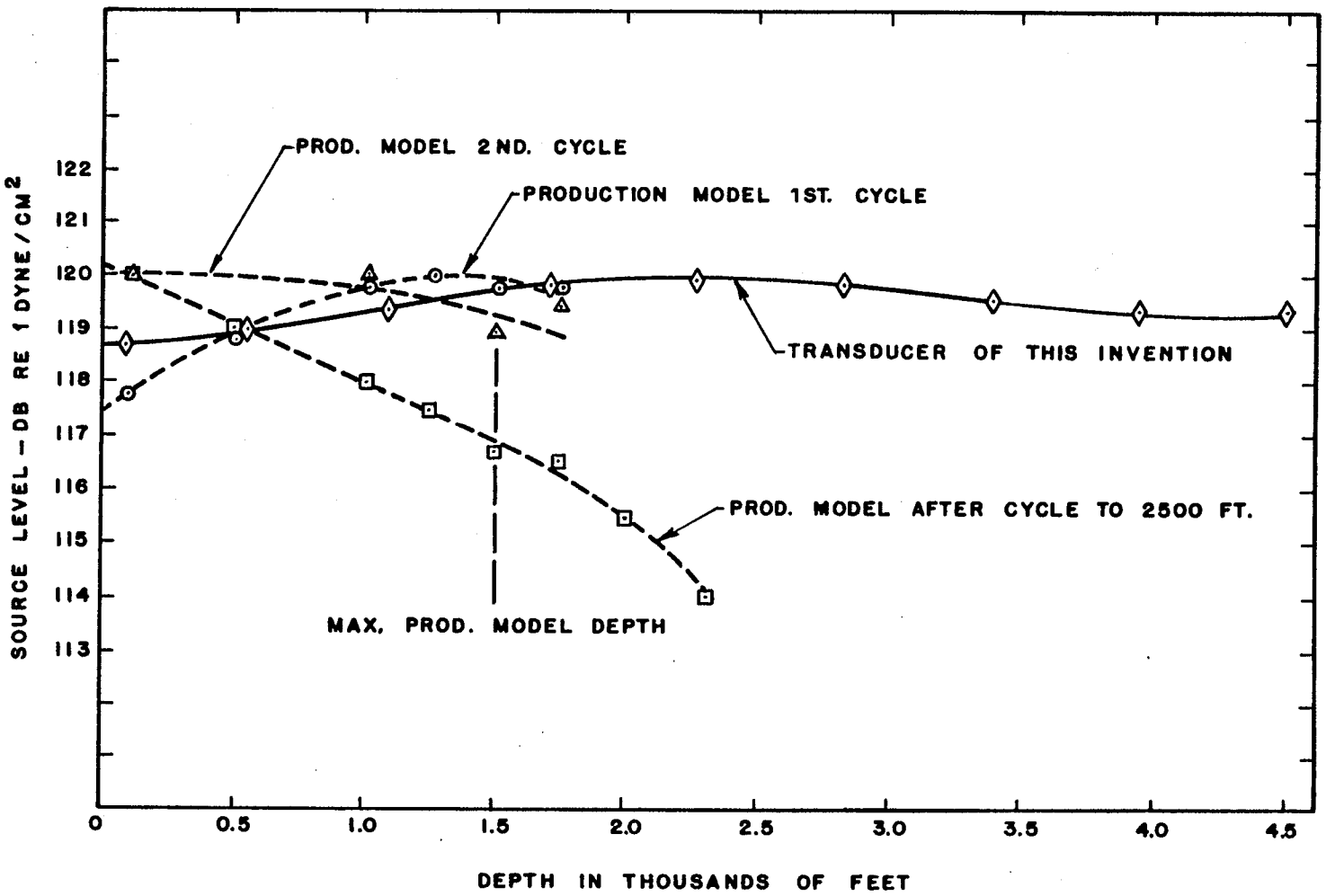
FIG. 7 is a graph showing a comparison of the source level as a function of depth for several transducer assemblies of the prior art, shown by dotted lines, and of the subject invention, shown by a full line.

Referring now to FIG. 7, it can be seen that, for the production transducer assemblies of the prior art, the source level drops, for one of the models, from 120.2 to 114 db, a difference of 6.2 db, when the torpedo depth changes from sea level to 2300 ft. it is to be noted that at this depth, 75% of the energy is gone. In contrast, the transducer assembly 10 of this invention, shown by a solid line, has an output which is constant within 1 db over a depth range of from sea level to a depth of 4500 ft.

From this figure, it may be seen that use of the embodiment of this invention results in an output which may be four times greater at some depths than the torpedo configurations of the prior art, and that the operational depth is doubled.

Obviously many modifications and variations of the present invention are possible in the light of the above teachings. It is therefore to be understood that within the scope of the appended claims the invention may be practiced otherwise than as specifically described.

What is claimed is:

1. A transducer assembly, useful at depths up to 4500 ft, comprising:

a diaphragm;

at least one transducer element, comprising a flat head and a cylindrical active part, bonded by its head to the diaphragm;

pressure-resistant means for supporting the transducer assembly;

an acoustic isolator disposed between the head and active part of the at least one transducer element and between the diaphragm and the pressure-resistant means the acoustic isolator not touching the active part of the at least one transducer element;

the material of the acoustic isolator being elastically linear and equal in thickness to one-quarter wavelength of the corresponding operating frequency of the transducer element.

2. A transducer assembly according to claim 1, further comprising:

a means to isolate extraneous noise from the transducer assembly.

3. A transducer assembly according to claim 2, wherein the noise-isolating means comprises:

an isolator ring, embedded in the diaphragm, whose circumference encompasses the at least one transducer element.

4. A transducer assembly according to claim 3, wherein the isolator ring is one-quarter wavelength thick.

5. A transducer assembly according to claim 4, wherein here are two or more transducer elements the acoustic isolator is in two sections, one section being located between the transducer heads, and the other section having a thickness of one quarter wavelength being located between the active parts of the transducers.

6. A transducer assembly according to claim 5, wherein the isolator section having a quarter wavelength thickness is segmented.

7. A transducer assembly according to claim 6, wherein the segments are of identical size and form, with the number of segments being approximately equal to the number of transducer elements.

8. A transducer assembly according to claim 6, wherein the segmented isolator consists of two substantially identical and sections and a middle section of approximately the same area as an end section.

9. A transducer assembly according to claim 3, wherein the diaphragm consists of an aggregate material having an acoustic impedance equal to that of seawater; and the isolator material consists of a prestressed mixture of siliceous particles, the isolator material having an acoustic impedance equal to that of seawater.

* * * * *